United States Patent [19]

Hafner, Jr.

[11] 4,399,322

[45] Aug. 16, 1983

[54] LOW LOSS BUOYANT COAXIAL CABLE

[75] Inventor: Kurt F. Hafner, Jr., Mystic, Conn.

[73] Assignee: The United States of America as represented by the Secretary of the Navy, Washington, D.C.

[21] Appl. No.: 344,417

[22] Filed: Feb. 1, 1982

[51] Int. Cl.[3] ..... H01B 7/12; H01B 11/06

[52] U.S. Cl. ..... 174/101.5; 174/107; 174/110 F; 174/131 A

[58] Field of Search ..... 174/101.5, 110 F, 131 A, 174/102 R, 107

[56] References Cited

U.S. PATENT DOCUMENTS

| | | | |
|---|---|---|---|
| 2,577,077 | 12/1951 | Forsberg | 174/101.5 |
| 3,155,768 | 11/1964 | Garshick | 174/101.5 |
| 3,309,458 | 3/1967 | Yoshimura et al. | 174/110 F |
| 3,710,006 | 1/1973 | Davis | 174/101.5 |
| 3,717,720 | 2/1973 | Snellman | 174/131 A |
| 3,766,307 | 10/1973 | Andrews, Jr. | 174/47 |
| 3,798,350 | 3/1974 | Clarke | 174/107 |
| 3,971,879 | 7/1976 | Rosenberg et al. | 174/107 |
| 3,980,808 | 9/1976 | Kikuchi et al. | 174/131 A X |
| 4,011,540 | 3/1977 | Farr | 174/101.5 X |

FOREIGN PATENT DOCUMENTS

| | | | |
|---|---|---|---|
| 971239 | 7/1975 | Canada | 174/131 A |
| 1025958 | 3/1958 | Fed. Rep. of Germany | 174/110 F |
| 1929967 | 12/1970 | Fed. Rep. of Germany | 174/101.5 |
| 136676 | 7/1979 | German Democratic Rep. | 174/107 |
| 53-18117 | 6/1978 | Japan | 174/110 F |
| 1007939 | 10/1965 | United Kingdom | 174/110.8 |
| 2023913 | 1/1980 | United Kingdom | 174/110 F |

*Primary Examiner*—A. T. Grimley
*Assistant Examiner*—Morris H. Nimmo
*Attorney, Agent, or Firm*—Robert F. Beers; Arthur A. McGill; Prithvi C. Lall

[57] ABSTRACT

A low loss buoyant coaxial cable has its buoyant material placed between its conductors to allow for maximum cable cross section for electrical transmission. In addition the strength members are placed radially inward of the center conductor to reduce wearing of the strength members and keeping the electrical performance independent of the electrical properties of the strength members. An alternate embodiment has buoyant material centrally located and the strength members placed with buoyant material between the coaxial conductors.

8 Claims, 5 Drawing Figures

LOW LOSS BUOYANT COAXIAL CABLE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

1. Field of the Invention

The described buoyant coaxial cable has use in a buoyant cable antenna system. Signals received via the antennal element are amplified by an inline amplifier and then transferred to the submarine via the buoyant coaxial cable. The length of the coaxial cable in the Standard Buoyant Cable Antenna System is 1900 ft. It is desired to extend the range of reception capability of the buoyant cable antenna system to a frequency of 400 MHz.

2. Description of the Prior Art

The RG-384/U buoyant coaxial cable comprises a prior art cable used in the buoyant cable antenna system. The attenuation of radio signals passing through 1900 ft. of RG-384/U is shown in Table 1 for various frequencies up to 400 MHz. The inline amplifier must have a gain greater than the attenuation of the cable to permit satisfactory reception of radio signals. There is a practical limit of 50 to 60 decibels to the amount of gain which can be provided by the inline amplifier thereby precluding reception of signals above a frequency of 100 MHz over the RG-384/U cable. Shorter lengths of RG-384/U have been employed in special systems to permit reception of radio signals of frequencies up to 160 MHz. The utilization of shorter lengths of RG-384/U significantly reduces the speeds and depths at which a submarine may receive radio signals.

SUMMARY OF THE INVENTION

The low loss buoyant coaxial cable provides a great improvement in attenuation over previously employed buoyant coaxial cables thereby permitting the transfer of higher frequency radio signals and/or utilization of greater lengths of cable. The improvement in attenuation is achieved through better design and arrangement of the functional components of the cable. Maximum utilization is made of the cable cross section for electrical transmission. This is achieved by placing the buoyant material between the coaxial conductors. In one embodiment, the strength members are placed within the center conductor thereby reducing wearing of the strength members and keeping the electrical performance independent of the electrical properties of the strength members.

DESCRIPTION OF THE PREFERRED EMBODIMENTS

Figure 1:
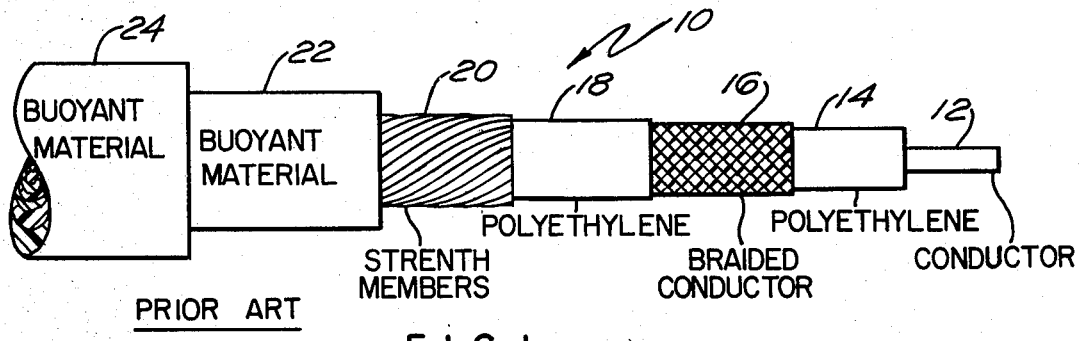
FIG. 1 is a cutaway view of a prior art buoyant coaxial cable.

Referring now to FIG. 1 there is shown the prior art RG-384/U cable 10. It comprises a center conductor 12 having a polyethylene covering 14. Over the covering 14 is an outer conductor 16 made of braided flat copper ribbon. Over this is a sheath 18 of solid polyethylene. Next in order from the inside outward are strength members 20 made of strands of latex coated Fiberglas. The outside jacket is formed by two layers of black foam polyethylene buoyant material 22 and 24.

As can be seen the RG-384/U cable comprises primarily a core comprising coaxial conductors 12 and 16 separated by a polyethylene dielectric 14. The necessary strength members 20 cover the core and then the buoyant material comprising jacket 22 and 24 surround this combination up to the maximum allowable diameter.

Figure 2:
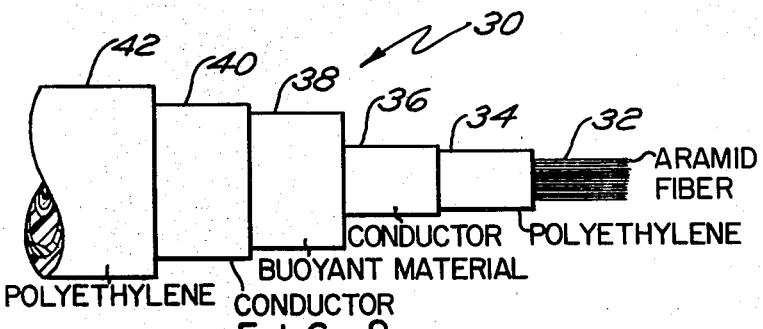
FIG. 2 is a cutaway view of a buoyant coaxial cable constructed in accordance with the present invention.
Figure 3:
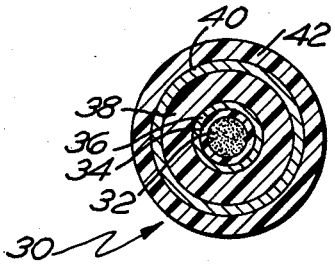
FIG. 3 is a cross sectional view of the cable of FIG. 2.

Referring now to FIGS. 2 and 3 there is shown the low loss buoyant cable 30. It comprises an aramid fiber 32 center having a polyethylene jacket 34. Over the jacket 34 is the inner conductor 36 of the coaxial cable. Over this is a low density foamed polyethylene dielectric buoyant material 38. Next in order from the inside outward is the outer conductor 40 of the coaxial cable. On the outside is a polyethylene outer jacket 42.

A feature of this low loss buoyant cable 30 is the placement of the buoyant material 38 between the coaxial conductors, thereby allowing the conductor diameters to be made as large as possible. The attenuation of this cable 30 at frequencies up to 400 MHz is shown in Table 1 and compared to the RG-384/U cable 10. This cable 30 has the same outer diameter, buoyancy, and tensile strength as the RG-384/U cable 10 which it is designed to replace. The low loss buoyant cable functions as a coaxial cable for the transfer of signals and power. It provides buoyancy to permit the cable to float to the water surface and tensile strength to prevent breakage during towing. The ratio of the conductor diameters is shown as the optimum of 3.51.

TABLE 1

COMPARISON OF BUOYANT COAXIAL CABLE ATTENUATIONS

| Frequency in MHz | Attenuation in dB/100 ft RG-384/U | Attenuation in dB/100 ft Low Loss Cable |
|---|---|---|
| 20 | 1.18 | 0.43 |
| 200 | 4.12 | 1.75 |
| 400 | 6.23 | 2.40 |

Figure 4:
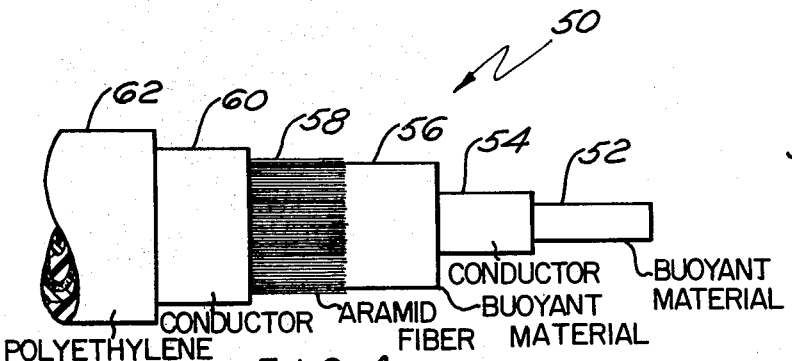
FIG. 4 is a cutaway view of an alternate embodiment of a buoyant coaxial cable constructed in accordance with the present invention.
Figure 5:
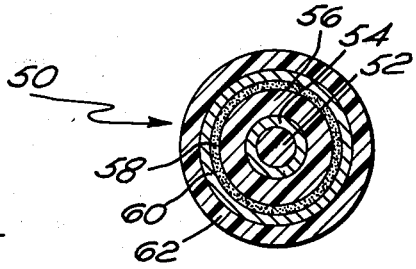
FIG. 5 is a cross sectional view of the cable of FIG. 4.

FIGS. 4 and 5 show an alternate embodiment of the invention. A cable 50 comprises a center of low density foamed polyethylene dielectric buoyant material 52 covered by inner conductor 54 of the coaxial cable. Over this is a layer 56 of the low density foamed polyethylene dielectric buoyant material. Aramid fiber strength members 58 cover the layer 56. Next in order from the inside outward is the outer conductor 60 of the coaxial cable. On the outside of cable 50 is a polyethylene outer jacket 62.

There has therefore been described a low loss buoyant coaxial cable that provides a signal path from a buoyant cable antenna element at the sea water surface to a submerged submarine. The buoyant coaxial cable must also provide sufficient buoyancy to reach the surface for required submarine depths and speeds. A complete buoyant cable antenna system, of which this invention is a part, permits reception of radio signals by a submarine while submerged. This invention will permit reception of higher frequency radio waves than possible with previously employed buoyant coaxial cables.

A feature of the low loss buoyant coaxial cable is the placement of the buoyant material between the coaxial conductors thereby allowing the conductor diameters to be made as large as possible. This design applies to any diameter cable. Any suitable material may be employed for the conductors. Any construction may be employed for the conductors such as foil, braided ribbon and braided strands. In addition to the foamed polyethylene material recited any suitable buoyant material may be employed such as foamed polypropylene or foamed TPX. In addition to aramid fibers any suitable type of strength members may be employed such as Fiberglas or metals.

It will be understood that various changes in the details, materials, steps and arrangement of parts, which have been herein described and illustrated in order to explain the nature of the invention, may be made by those skilled in the art within the principle and scope of the invention as expressed in the appended claims.

What is claimed is:

1. A low loss buoyant cable comprising:
a strength material center;
an inner jacket covering said strength material center;
a coaxial cable inner conductor covering said inner jacket;
a low density buoyant material covering said inner conductor;
a coaxial cable outer conductor covering said low density buoyant material;
an outer jacket covering said outer conductor; and
said low loss buoyant cable having amounts of the preceding components in such proportion as to be buoyant in water and all of said components are concentric.

2. A low loss buoyant cable according to claim 1 wherein said buoyant material is foamed polyethylene.

3. A low loss buoyant cable according to claim 1 wherein said buoyant material is foamed polypropylene.

4. A low loss buoyant cable according to claim 1 wherein said buoyant material is foamed TPX.

5. A low loss buoyant cable comprising:
a center of buoyant material;
a coaxial cable inner conductor covering said center of buoyant material;
a covering of buoyant material over said coaxial cable inner conductor;
strength material covering said covering of buoyant material;
a coaxial cable outer conductor covering said strength material;
an outer jacket covering said coaxial cable outer conductor; and
said low loss buoyant cable having amounts of the preceding components in such proportions so as to be buoyant in water and all of said components are concentric.

6. A low loss buoyant cable according to claim 5 wherein said buoyant material is foamed polyethylene.

7. A low loss buoyant cable according to claim 5 wherein said buoyant material is foamed polypropylene.

8. A low loss buoyant cable according to claim 5 wherein said buoyant material is foamed TPX.

* * * * *